US005312286A

United States Patent [19]

Domen

[11] Patent Number: 5,312,286

[45] Date of Patent: May 17, 1994

[54] FLYING TOY

[76] Inventor: Jean-Paul Domen, 13 rue Ganneron, 75018 Paris, France

[21] Appl. No.: 89,632

[22] Filed: Jul. 12, 1993

Related U.S. Application Data

[63] Continuation of Ser. No. 868,456, Apr. 14, 1992, abandoned.

[30] Foreign Application Priority Data

Apr. 30, 1991 [FR] France ..... 91 05318

[51] Int. Cl.[5] ..... A63H 27/26; A63H 3/06

[52] U.S. Cl. ..... 446/187; 446/211; 446/225

[58] Field of Search ..... 446/187, 186, 183, 176, 446/201, 211, 217, 218, 220, 222, 225, 223, 226

[56] References Cited

U.S. PATENT DOCUMENTS

| | | | |
|---|---|---|---|
| 1,241,822 | 10/1917 | Looney | 446/186 |
| 1,291,991 | 1/1919 | Marui | 446/225 |
| 1,350,935 | 8/1920 | Pastor | 446/222 |
| 1,479,163 | 1/1924 | Tyrrell | 446/217 X |
| 1,596,852 | 8/1926 | Foster | 446/187 X |
| 1,994,842 | 3/1935 | Turner | 446/186 |
| 2,781,610 | 2/1957 | Yamauchi | 446/187 |
| 2,879,624 | 3/1959 | Benson | 446/187 |
| 3,267,604 | 8/1966 | Goldsmith | 446/222 |
| 3,613,303 | 10/1971 | Allen | 446/186 |
| 4,428,149 | 1/1984 | Brown | 446/222 |

FOREIGN PATENT DOCUMENTS

| | | | |
|---|---|---|---|
| 453107 | 12/1948 | Canada | 446/225 |
| 2476493 | 8/1981 | France | 446/222 |
| 18941 | of 1912 | United Kingdom | 446/176 |
| 139117 | 2/1920 | United Kingdom | 446/222 |
| 2145001 | 3/1985 | United Kingdom | 446/211 |

*Primary Examiner*—David N. Muir
*Attorney, Agent, or Firm*—Bush, Moseley & Riddle

[57] ABSTRACT

A flying toy comprising an ordinary rubber balloon and a nozzle, the nozzle being provided with a wide inlet edge and with a narrow outlet throat, and being secured to the inflation appendage of the balloon. The nozzle is provided with studs suitable for receiving drinking straws that have themselves received fins, thereby constituting a trajectory stabilizer. The flying toy thus constitutes a rocket-balloon. It constitutes an educational toy and an advertising medium particularly suitable for fast-food restaurant chains.

15 Claims, 2 Drawing Sheets

FIG. 1
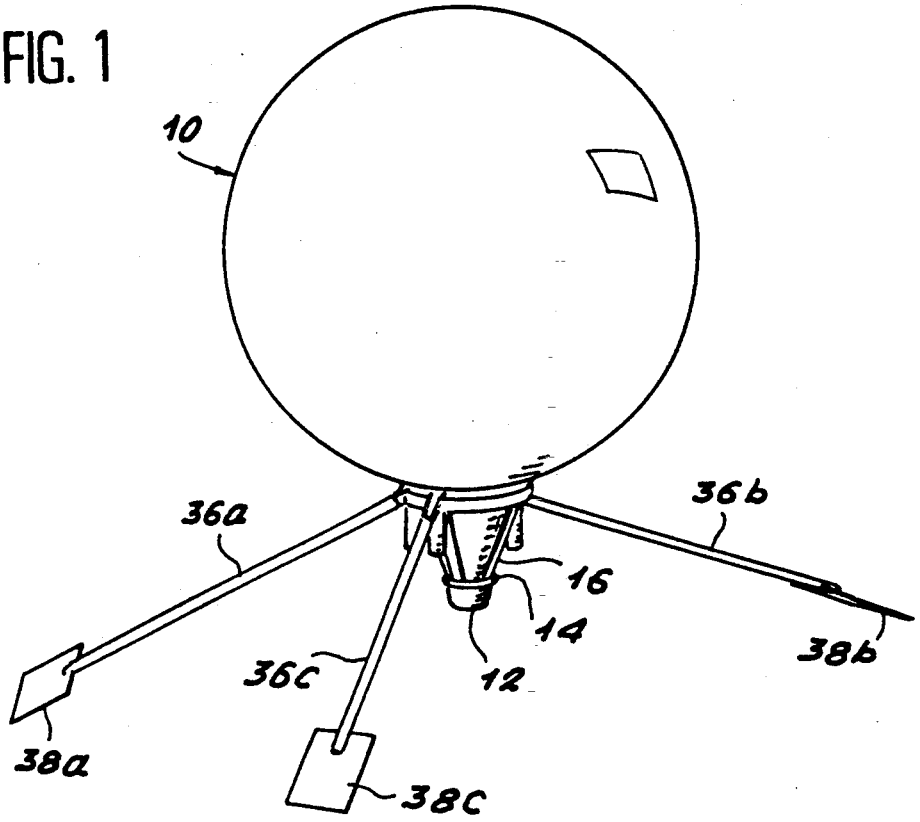
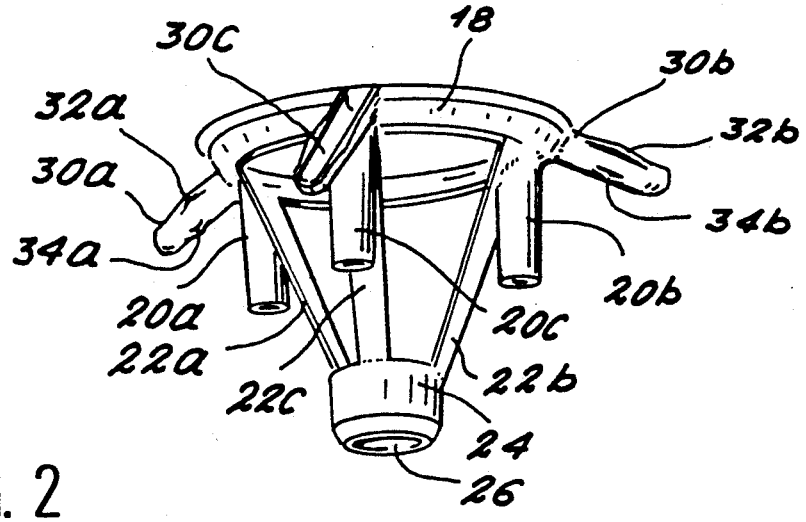
FIG. 2

FLYING TOY

This application is a continuation, of application Ser. No. 07/868,456 filed Apr. 14, 1992, abandoned.

The invention relates to a flying toy of the kind in which propulsion is provided by the potential energy stored in the elastic wall under tension of an inflated balloon or ball, for example.

BACKGROUND OF THE INVENTION

A known flying toy of this type is described on page 7 of the April 1991 "Business gifts" catalogue of the French firm Fix Shop in Strasbourg. That flying toy, called an "Astronaut-jet", comprises a conventional inflatable balloon, a model figure made of foam rubber, and an assembly accessory. The model figure represents an astronaut with slightly bent legs and carrying a backpack. A cylindrical duct passes from top to bottom through the backpack and is occupied by a balloon inflation appendage. The assembly accessory is a tube inserted into the end of the appendage that projects from the backpack. It serves both to hold all the parts together and also to provide a mouthpiece for inflating the balloon and an air ejection nozzle while the balloon is deflating.

According to the catalogue, with a fully-inflated balloon of good quality, the resulting jet flying toy may overfly as many as five meters, according to the catalogue (with the altitude achieved not being mentioned). Given the complex shape of the object and the distance between its center of gravity and the thrust axis of the jet, this is a relatively advantageous result that is liked by children. However, such performance is far from satisfying an aeronautical engineer.

In general terms, the object of the invention is to provide a family of flying toys that make best use of the potential energy accumulated in the elastic wall under tension of an inflated balloon.

Reduced to its essential characteristics, a first particular object of the invention is to provide, by means of an elastic-walled balloon and a novel nozzle, a jet flying toy capable of rising to a relatively great height.

A second particular object of the invention is to provide, by means of an elastic-walled balloon, a novel nozzle provided with fastenings of a first type, and a trajectory stabilizer of a first type fixed to said fastenings, a jet flying toy suitable for rising to a relatively great height and for following a determined trajectory that is adjustable in advance.

A third particular object of the invention is to provide, by means of an elastic-walled balloon, a novel nozzle provided with fastenings of a second type, and a trajectory stabilizer of a second type fixed to one of said fastenings, a jet flying toy, likewise capable of rising to a relatively great height.

A fourth particular object of the invention is to provide by means of an elastic-walled balloon, a novel nozzle provided with fastenings of both said first and said second types, and associated with appropriate accessories, a jet flying toy capable of flying and gliding over a relatively great distance.

SUMMARY OF THE INVENTION

According to the invention, a flying toy of the type comprising firstly a balloon having a highly extensible elastic wall and a base provided with an inflation appendage, and secondly a nozzle for ejecting air from the balloon is characterized in that:

The nozzle has a large inlet edge and a narrow outlet throat;

the nozzle is adapted to be engaged around the appendage, with its inlet edge pressing against the base of the balloon and with the end of the appendage folded back over the throat; and the nozzle installed in this way on the appendage being secured to the balloon when inflated and serving as a closure member therefor when sufficient twisting is applied to the base of the balloon.

Because of this disposition, the center of gravity of the assembly is situated substantially on the thrust axis of the nozzle. In addition, if the weight of the nozzle is high enough for the center of gravity to be situated significantly below the center of buoyancy thrust applied to the balloon, then it is ensured that the balloon is stable and thrust from the nozzle is vertical. Under such circumstances, the rocket-balloon balloon of the invention rises vertically and may reach a height of a few meters. However the height reached is inversely proportional to the weight of the assembly, and in the present circumstances that is naturally not an optimum situation.

According to a first additional characteristic of the invention, the flying toy includes a trajectory stabilizer of a first type, constituted by relatively rigid lightweight rods with fins at one end and securely fixed at the opposite end to fastenings of a first type that are uniformly disposed around the nozzle, said fastenings being adapted to hold said rods spaced apart in the same way around the thrust axis of the nozzle.

A jet flying toy of a second type can thus be constituted by these dispositions using an ordinary rubber balloon, a novel nozzle provided with three sloping studs constituting fastenings of the first type, and three drinking straws each fitted with a small square of cardboard to constitute fins. Because the masses are uniformly distributed around the axis of symmetry of the balloon, and because the center of gravity of the assembly is lowered by the straws in spite of their lightness, the trajectory of this novel toy can easily be made vertical by adjusting the fins. Under such circumstances, and using a good quality rubber balloon, it is possible to achieve a height of about a dozen meters. That is remarkable.

According to a second additional characteristic of the invention, the flying toy includes a trajectory stabilizer of a second type, the stabilizer being constituted by a single rod that is relatively long and stiff, that preferably includes fins at one end, and that is securely fixed at its opposite end to one of a plurality of fastenings of a second type regularly disposed around the nozzle, each of said fastenings being adapted to hold said rod substantially parallel to the thrust axis of the nozzle.

Because of these dispositions, it is easy to make a third type of flying toy of the invention. Such a toy comprises a conventional rubber balloon, a novel nozzle provided with fastenings of a second type and constituted, for example, by three small elongate cylindrical housings disposed parallel to the thrust axis of the nozzle, and by the rod which is conventionally used for holding such a balloon in the hand, which rod has fins like the flights of an arrow. The performance of such a toy is comparable to that of the first type of flying toy described above, but accurate adjustment of its trajectory is more difficult.

According to a third additional characteristic of the invention, the flying toy is a rocket-airplane comprising a balloon having a highly elastic wall, a novel nozzle provided with three fastenings of said first type and three fastenings of said second type disposed one above the other, a fuselage constituted by a finned rod that is relatively long and rigid and fixed to one of the fastenings of the second type, and two wings each constituted by a wing spar secured to a skin, the wing spars being relatively stiff lightweight rods and the skins being elongate sheets of paper, said wings being fixed by means of their spars to two fastenings of the first type disposed on either side of the fuselage.

By means of these dispositions, a flying toy of a fourth type is provided which, when using a properly inflated balloon of good quality, is capable of rising to an altitude of about 10 meters and then of gliding over about 20 meters before landing.

BRIEF DESCRIPTION OF THE DRAWINGS

Embodiments of the invention are described by way of example with reference to the accompanying drawings, in which:

FIG. 1 shows a first flying toy of the invention;

FIG. 2 is a perspective view of a nozzle of the invention;

DETAILED DESCRIPTION

Figure 3:
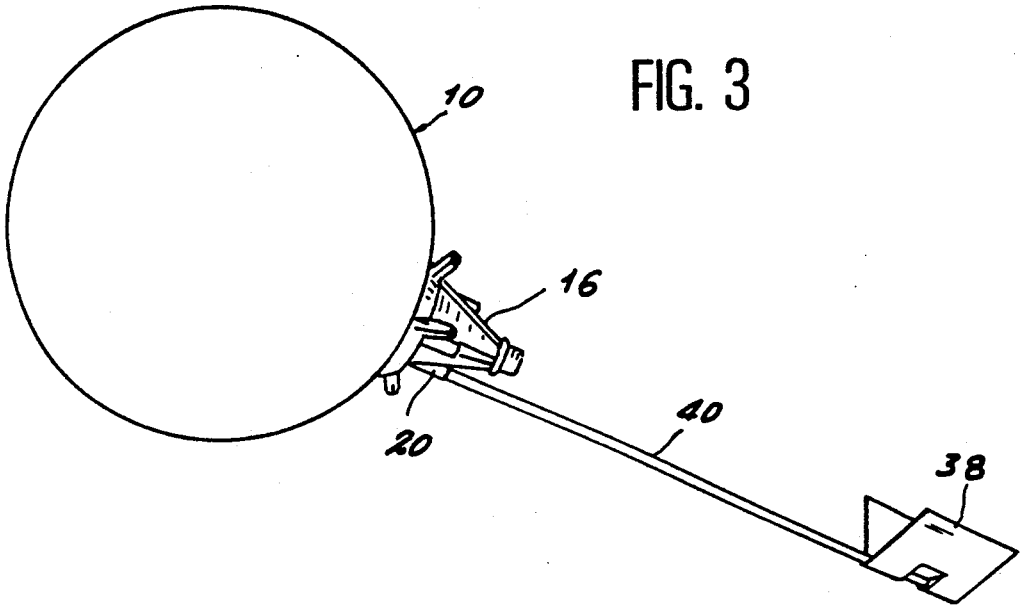
FIG. 3 shows a second flying toy of the invention.

In FIG. 1, a first flying toy of the invention comprises firstly a rubber balloon 10 of ordinary type provided with a flexible inflation appendage 12 terminated by an elastic rim 14. Empty, such a balloon weighs 3 grams (g). When inflated as far as possible by a child, it contains about 30 liters of air at a relative pressure of 20 hectopascals, with the stored energy being about 60 Joules. Its diameter is then about 40 centimeters and the area of its stretched wall is about 16 times greater than its area when empty. A nozzle 16 is associated with the balloon 10 and its appendage 12, the nozzle having a relatively stiff thin wall made of injected plastic and weighing about 1 gram.

In FIG. 2, the nozzle 16 is constituted by a small bottomless tapering basket constituted by a relatively wide circular collar 18, three straps 22*a*, 22*b*, and 22*c* connecting it to a tapering neck 24 provided with a small outlet 26. For example, the nozzle 16 may be 40 millimeters high, the collar 18 may be 36 millimeters in diameter, the straps 22 may be 15 millimeters long, and the neck 24 may be 15 millimeters high and may have an outlet diameter of 10 millimeters. The straps 22*a*, 22*b*, 22*c* are associated with respective ten millimeter long tubular connections 20*a*, 20*b*, 20*c* disposed parallel to the thrust axis of the nozzle 16. Each of these connections 20 is connected at one end to the collar 18 and is open at its other end directed towards the neck 24. The collar 18 of the nozzle 16 includes three hollow studs 30*a*, 30*b*, and 30*c* disposed at 120° intervals from one another, each being 10 millimeters long, 8 millimeters across, and sloping at an angle of about 70° relative to the axis of the nozzle 16. These studs 30 are channel section members being open to the side facing away from the neck 24 (so as to simplify the mold used for making the nozzles), and each of them has an enlarged central portion 32 and a terminal claw 34. As defined above, the studs 30 constitute fastenings of the first type, while the tubular connections 20 constitute fastenings of the second type.

In FIG. 1, respective lightweight hollow rods 36*a*, 36*b*, and 36*c*, e.g. conventional drinking straws, are fixed on the studs 30*a*, 30*b*, and 30*c*. Because of the enlargement 32 and the claw 34 on each stud 30, the hollow rods 36 are securely held in place. Together the three rods 36*a*, 36*b*, and 36*c* weigh about 2 grams, and each of them is about 20 centimeters long and has an inside diameter of 6 millimeters. Each of the rods 36*a*, 36*b*, and 36*c* has a fin 38*a*, 38*b*, or 38*c* fixed thereto. To this end, a square of side about 4 centimeters and a central fixing tongue of width 8 millimeters and length 15 millimeters are initially cut out from bristol board type card, with each fin made in this way weighing about one-fourth of a gram. The fixing tongue of each fin 28 is inserted into a hollow rod 36 and each of the hollow rods is then engaged on a stud 30 of the collar 18 of the nozzle 16.

In FIG. 3, a second flying toy of the invention is shown. It comprises a rubber balloon 10 fitted with a nozzle 16 as shown in FIG. 2. A rigid and relatively long (e.g. 50 cm) rod 40 is engaged in one of the fastenings of the second type constituted by one of the tubular connections 20, and the rod is provided with a fin 38. The rod 40 may, for example, be the rod conventionally provided with an inflatable rubber balloon and provided with an accessory for closing the balloon and for fixing the rod to the balloon, thereby enabling a child to hold the balloon in the hand. The fin 38 is similar to that of the toy shown in FIG. 1.

Figure 4:
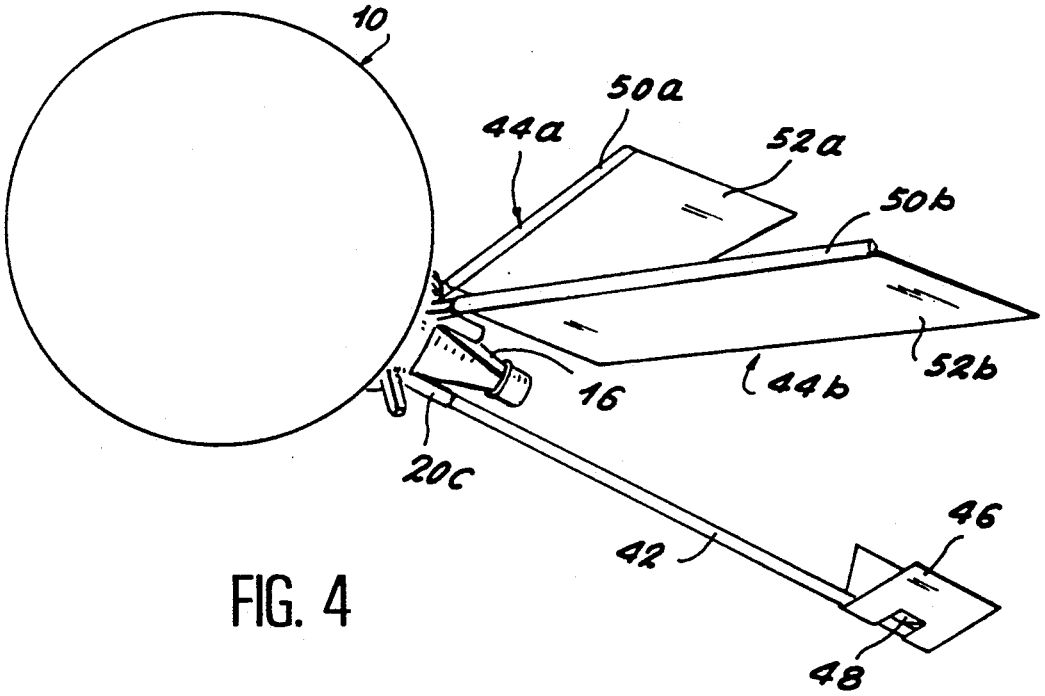
FIG. 4 shows a third flying toy of the invention.

FIG. 4 shows a rocket aircraft of the invention comprising an ordinary rubber balloon 10, a nozzle 16 identical to that described with reference to FIG. 2, a fuselage 42 and two wings 44*a* and 44*b*. The fuselage 42 is a relatively long and rigid rod (in practice of the rod 40 of FIG. 3) provided with a V-shaped fin 46 at one end and secured at its other end in one of the three fastenings of the second type, namely the tubular connection 20*c*, so that it extends substantially parallel to the thrust axis of the nozzle 16. The "tail" fin 46 is made of a sheet of paper having dimensions about 5 cm by about 10 cm, and folded in half after two slots have been formed therein to provide a retaining strip 48. Each of the wings 44 comprises a spar 50 and a skin 52. The two spars are constituted by two common drinking straws and the skins 52 are constituted by two elongate sheets of paper having dimensions about 10 cm by about 30 cm, e.g. cut out from a standard A4 format sheet of paper. The wings 44*a* and 44*b* are secured to two fastenings of the first type constituted by studs 30*a* and 30*b* by means of their spars 50.

To assemble the parts of the various flying toys described above, the child begins by installing the nozzle 16 on the appendage 12 of the balloon 10. To this end, when the balloon 10 is empty, means such as one of the drinking straws 36 are used to push the appendage 12 through the nozzle 16 until it comes out through the neck 24. Thereafter the collar 18 is engaged around the base of the balloon 10 so that a large portion of the appendage 12 projects from the neck 24 and can then be folded back thereover until the elastic rim 14 of the appendage 12 can be engaged over the bottom edges of windows delimited by the connection straps 22*a*, 22*b*, 22*c*, thereby ensuring that the rim 14 is effectively secured in its initial position. Thereafter, the child inflates the balloon by mouth and then grasps the nozzle in one hand while preventing air escaping with a finger, and with the other hand rotates the nozzle about its own axis so as to twist the base of the balloon and close off the inflation appendage. At this moment the nozzle is secured to the inflated balloon and serves to close it. The child can then take all the time required for finishing off the toy.

To make a first toy as shown in FIG. 1, the child cuts out the fins 38 from card together with their fixing tongues, following dotted lines marked for this purpose. Thereafter each tongue is engaged in a straw 36 and the straws are engaged on the studs 30 of the nozzle 16. To make the toy easier to hold, the rod 40 shown in FIG. 3 is engaged in the tubular connection of one of the straps 20. When the child decides to fly the toy, the rod in question is removed, the twisting applied to the base of the balloon is undone, the balloon being kept closed with a finger, and the toy is stood on the ground using the three legs constituted by the three straws, after which the finger is withdrawn. At which point the balloon fitted in the manner of the invention rises like a rocket.

The conditions under which this takes place are determined by the characteristics specific to each of the component parts of the rocket balloon of the invention. Using the numerical values given above, a jet flying toy of the invention weighs a little less than 6 grams in air on launch, with the weight of the air (40 g), stored in the balloon being substantially compensated by buoyancy. Using the above figures, the initial theoretical velocity of the air jet is 60 meters per second (m/sec), and given the moving masses involved, the vertical acceleration applied to the toy is 2 m/sec$^2$. This initial velocity and initial acceleration fall off progressively as the balloon 10 deflates and looses potential energy. The acceleration begins by raising the toy slowly and then by imparting a cruising speed thereto relatively quickly, which speed is limited to about 3 m/sec, given air resistance. The decreasing thrust of the jet then exactly compensates the weight of the balloon in air and the decreasing drag to which it is subjected. Thereafter the upwards velocity of the rocket balloon falls off until it stops moving upwards shortly after the jet stops applying thrust. Thereafter it falls, generally while rotating, with its fins uppermost. The greatest height to which a jet flying toy of the invention can go when made using a good quality rubber balloon is about a dozen meters, and it takes about 5 seconds to reach that altitude. In spite of the low energy efficiency inherent to low velocity rockets (about 1.5%), this constitutes a remarkable performance for a device that is so simple.

Experience of the motion of such a rocket balloon about its center of gravity and of its departures from the expected trajectory shows firstly that the rocket exhibits excellent pitching stabilization which is obtained automatically and secondly, that it can be caused to follow a given trajectory, in particular vertically, by appropriate adjustments of its fins.

Given the masses of the components of such a jet device and given their distribution in three dimensions, it may be observed that for pitching purposes its center of gravity is placed a little below the outlet from the neck 26 of the nozzle 16 and the total value of its pitching inertia is very high (sum of the moments of inertia about pitching axes for the component parts of the toy, for the mass of air inside the balloon, and the mass of air outside the balloon that is displaced by the balloon pitching). As a result of this state of affairs, even without the action of the fins, such a rocket balloon of the invention suffers little from pitching, by construction.

A particular trajectory assigned to such a rocket balloon can be stabilized by adjustments that consist in changing the extent to which one or two of the straws are engaged on their fixing studs and/or the extent to which the tongues of the fins are engaged in the straws. If it is desired that the rocket balloon should have a trajectory that is as vertical as possible, then the adjustments consist in placing the center of gravity of the rocket balloon as accurately as possible on the thrust axis of the nozzle. If it is desired to cause the rocket balloon to turn through a given number of turns as it goes up, then the adjustment consists in rotating at least one of the straws through an appropriate angle about its fixing stud, thereby changing the angular position of its fin.

To complete the second flying toy of the invention as shown in FIG. 3, the child inserts an arrow constituted by the rod 40 provided with flights 38 in one of the fastenings of the second type constituted by the tubular connections 30 of the nozzle 16. The way in which the second flying toy of the invention is put into operation is entirely comparable to that described above for the first toy. The resulting performance is comparable, but it is difficult using the simplified trajectory stabilizer to set the trajectory followed by the rocket accurately and, in addition, the attractive appearance of a rocket balloon standing on a tripod is lost.

To complete the third toy of the invention as shown in FIG. 4, the child begins by building the wings of the rocket airplane. To this end, two drinking straws are used as wing spars 50 and two sheets of suitably cutout paper are used as skins 52. To do this, a sheet of ordinary A4 format paper is cut lengthwise into two equal portions and then a triangle is removed from one of the ends of each of the half-sheets obtained in this way. Thereafter, the long sides of the sheets prepared in this way are glued over a margin of width substantially equal to the circumference of the drinking straws used for making the wing spars. The straws are then rolled up in the glue-coated margins taking care to leave a sufficient length of spar adjacent to the removed triangle to be able to engage each of the wings on one of the fastenings of the first type as constituted by the three studs 30. Once this operation has been completed, the child installs the fuselage 42 of the rocket-airplane. To do this, a previously finned rigid and relatively long rod is used which is inserted in that one of the fastenings of the second type which is constituted by the tubular connection 20 disposed in the plane of symmetry between the two wings 44*a* and 44*b*.

Such a rocket-airplane has roll stability because its wings have a positive dihedral established by the three studs 30 being uniformly distributed about the thrust axis of the nozzle 16. It also has yaw stability because the wings are swept back by the way the studs 30 slope. To obtain pitching stability, it is necessary merely to adjust the incidence of the wings, and is easily achieved. This is done by rotating the hollow spar 50 of each ring 44 about its fixing stud 30. With a properly inflated rubber balloon of good quality, such a rocket-airplane when launched at an upwards angle of 45° climbs quickly to about 10 meters and then glides over about 20 further meters before landing. This is quite remarkable given the simplicity of the means used and how cheap they are.

The advantages of jet flying toys of the invention stem directly from their performance and from their cost. All of them are educational toys that can be afforded by young people and that are particularly attractive for them in clubs or individually if they are interested in aviation or in space flight. In addition, jet flying toys of the invention are suitable for constituting advertising gifts for numerous businesses. This is particularly true of fast-food businesses since they already dispense drinking straws and they often given their young customers rubber balloons bearing their trademark. In general, flying toys of the invention will be sold in the form of construction kits. In some cases, such a kit may include confectionary.

The invention is naturally not limited to the particular embodiments described above by way of non-limiting example. Instead of using a single rubber balloon as the source of driving energy, it will be possible to use a much larger balloon, e.g. a balloon of the type used in meteorology. Nevertheless, under such circumstances, a compressor would be necessary for inflation purposes and the straws of the trajectory stabilizer should be replaced by stronger hollow rods. For the fins and the skins of the rocket-airplane, sheets of bristol board or relatively stiff plastic would be used. The special members of the invention (nozzle) for association with a meterological balloon would naturally need to be of dimensions chosen to match the dimensions of the balloon used.

Another variant consists in replacing the three windows pierced through the thin wall of the nozzle by three cutouts in the form of circular arcs or by a single circular rim. In both cases, the elastic rim 14 of the balloon appendage may bear thereagainst. The solution described (large windows) is nevertheless preferred since it reduces the weight and the cost of the nozzle.

Another variant consists in making the nozzle 16 out of relative thick and lightweight molded expanded plastic, e.g. polystyrene foam, instead of using thin plastic that is injected or that is thermoformed. When using a foam plastic, the wide inlet edge and the narrow outlet throat required by the nozzle apply only to its inside surface, while its outside surface may be of any shape providing: (1) the center of gravity of the object is situated substantially on the axis of symmetry of its inside wall; (2) the outside wall of the outlet throat is of reduced thickness and is provided with a notch or with a rim for enabling the balloon appendage to be folded back and fixed thereto; and (3) instead of and in place of the sloping studs and the connection tubes of a thin plastic nozzle, small cavities are provided that are adapted to serve as fastenings of the first and second types, suitable for receiving the rods forming parts of a trajectory stabilizer, of a fuselage, or of the wings of a flying toy of the invention. Either type of fastening may be present in a number other than three, even though three is the optimum number. In particular, with a thick-walled nozzle, it should be observed that the larger the number of fastenings, the smaller the weight of the nozzle.

I claim:

1. An air ejection nozzle adapted for use with a toy balloon having a highly extensible elastic wall and a base provided with an inflation appendix;

said nozzle having an exterior and a thrust axis and comprising a wide inlet edge and a narrow outlet throat;

said inlet edge adapted to bear against a balloon base;

said outlet throat being adapted to receive a folded portion of an appendix of a toy balloon;

said nozzle becoming a closure means for a toy balloon when said balloon is installed with said nozzle, inflated and then rotated relative to said nozzle;

said nozzle further comprising at least one generally cylindrical mounting means disposed upon said nozzle exterior between said inlet edge and said outlet throat, said mounting means displaced from said thrust axis;

said mounting means being adapted to securely hold aside said thrust axis, a relatively rigid, lightweight, long and thin cylindrical member in a direction substantially parallel to said thrust axis.

2. A jet flying toy comprising:

a toy balloon having a highly extensible elastic wall and a base provided with an inflation appendix;

an air ejection nozzle having an exterior and a thrust axis and comprising a wide inlet edge and a narrow outlet throat;

said inlet edge being adapted to bear against a toy balloon base;

said outlet throat being adapted to receive a folded portion of an inflation appendix of a toy balloon;

said nozzle including at least one generally cylindrical mounting means disposed upon said nozzle exterior between said inlet edge and said outlet throat, said mounting means displaced from said thrust axis;

said mounting means being adapted to securely hold aside said thrust axis a relatively rigid, lightweight, long and thin cylindrical member in a direction substantially parallel to said thrust axis; and a trajectory stabilizer constituted by one relatively rigid, lightweight, long and thin member mounted on one of said mounting means, said long and thin member being provided with a fin.

3. An air ejection nozzle adapted for use with a toy balloon having a highly extensible elastic wall and a base provided with an inflation appendix;

said nozzle having a thrust axis and comprising a wide inlet edge and a narrow outlet throat;

said inlet edge being adapted to bear against a balloon base;

said outlet throat being adapted to receive a folded portion of an inflation appendix of a toy balloon;

said nozzle becoming a closure means for a toy balloon when said balloon is installed with said nozzle, inflated and then rotated relative to said nozzle;

said nozzle further comprising at least three mounting means uniformly distributed around said thrust axis;

said mounting means being adapted to securely hold relatively rigid, lightweight, long and thin cylindrical members, in directions that slope relatively to said thrust axis.

4. An air ejection nozzle according to claim 3, having a relative thin wall of injected plastic and in which said inlet edge is a circular collar and said outlet throat is a tapering neck;

said mounting means are studs secured to said collar which project out of said thrust axis at about 70°;

said studs being able to securely hold long and thin tubular members;

said collar and said neck are connected together by connection straps leaving openings between said collar and said neck.

5. An air ejection nozzle according to claim 3, having a relative thin wall of injected plastic and in which said inlet edge is a circular collar and said outlet throat is a each of said mounting means is a cylindrical tube having one of its ends secured to said circular collar and the other end open and directed towards said neck;

said collar and said neck are connected together by connection straps leaving openings between said collar and said neck.

6. An air ejection nozzle adapted for use with a toy balloon having a highly extensible elastic wall and a base provided with an inflation appendix, said nozzle comprising:

a wide inlet edge and a narrow outlet throat, defining a thrust axis, carried by said inlet edge;

mounting means of a first type uniformly distributed around its thrust axis and adapted to securely hold relatively rigid and lightweight long members in directions that slope relative to said axis;

said inlet edge adapted to bear against a balloon base, said outlet throat adapted to receive a folded portion of an inflation appendix of a balloon;

wherein said nozzle functions to prevent air from escaping from a balloon when a balloon is installed with said nozzle, inflated, and then rotated relative to the nozzle;

three mounting means of said first type disposed close to said inlet edge and further including:

three mounting means of a second type disposed between said inlet edge and said outlet throat beneath respective mounting means of said first type, said mounting means of said second type being adapted to hold relatively rigid and lightweight long members substantially parallel to said thrust axis of said nozzle.

7. An air injection nozzle according to claim 6, wherein:

said inlet edge is a circular collar and said outlet throat is a tapering neck;

mounting means of said first type are three studs secured to said collar which project out from said thrust axis at about 70°;

mounting means of said second type are three cylindrical tubes, each having one of its ends secured to said collar and the other of its ends open and directed towards said neck; and said collar and said neck are connected together by three connection straps leaving openings between said collar and neck, each of said straps being integral with a stud and a one cylindrical tube, said collar, neck and straps being formed of relatively thin injected plastic.

8. A jet flying toy adapted to fly and to glide comprising:

a toy balloon having a highly extensible elastic wall and an inflation appendix;

an air ejection nozzle having a wide inlet edge and a narrow outlet throat and a thrust axis;

said nozzle including three first type mounting means uniformly disposed around its inlet edge, said first type mounting means being adapted to hold relatively rigid and lightweight long members in directions that slope relative to the thrust axis of the nozzle at about 70°;

said nozzle also including three second type mounting means disposed between the inlet edge and the outlet throat of the nozzle respectively beneath said first type mounting means, said second type mounting means being adapted to hold relatively rigid and lightweight long members substantially parallel to said thrust axis;

said nozzle being adapted to be mounted on said appendix with its inlet edge bearing against the balloon base and with a part of the appendix being folded back over said outlet throat;

said nozzle becoming a closure means when said balloon is inflated and then rotated relative to the nozzle;

a fuselage defined by one of said long members provided with a fin, said fuselage removably fixed on one of said second type mounting means;

two wings, each comprising a spar and a skin, said spar being one of said long members and said skin being an elongated sheet of paper secured on said spar; and said wings being fixed by means of their spars to two of said first type mounting means which are symmetrically disposed about said nozzle.

9. A jet flying toy according to claim 8, wherein:

said nozzle possesses a relatively thin wall of injected plastic;

said inlet edge is a circular collar and said outlet throat is a tapering neck;

said first type mounting means are three studs secured said inlet collar;

said second type mounting means are three cylindrical tubes having an open end directed towards said neck;

said collar and said neck are connected together by three connecting straps thereby leaving openings in said wall of said nozzle, each of said straps being integral with one of said studs and with one of said cylindrical tubes; and said fuselage is a thin relatively rigid and lightweight long member and said wing spars are two drinking straws.

10. An air ejection nozzle adapted for use with a toy balloon having a highly extensible elastic wall and a balloon base provided with an inflation appendix, said nozzle comprising, a wide inlet edge and a narrow outlet throat;

at least one mounting means of a type adapted to securely hold a relatively rigid and lightweight long member in a direction substantially parallel to its thrust axis; said nozzle adapted to be engaged around an appendix of a toy balloon with its inlet edge bearing against a balloon base and with a part of said appendix being folded back over said outlet throat;

said nozzle having a relatively thin wall of injected plastic and adapted to be a closure means when said toy balloon is inflated and then rotated relative to said nozzle;

said inlet edge being a circular collar and said outlet throat being a tapering neck; and each of said mounting means comprising a cylindrical tube having one of its ends secured to said circular collar and the other one open and directed towards said neck; said collar and said neck being connected together by connection straps thereby producing openings in said nozzle.

11. An air ejection nozzle adapted for use with a toy balloon having a highly extensible elastic wall and a base provided with an inflation appendix, said nozzle comprising:

a wide inlet edge and a narrow outlet throat, defining a thrust axis, carried by said inlet edge;

mounting means of a first type uniformly distributed around its thrust axis and adapted to securely hold relatively rigid and lightweight long members in directions that slope relative to said axis;

said inlet edge adapted to bear against a balloon base, said outlet throat adapted to receive a folded portion of an inflation appendix of a balloon;

wherein said nozzle functions to prevent air from escaping from a balloon when a balloon is installed with said nozzle, inflated, and then rotated relative to the nozzle;

said inlet edge defining a circular collar and said outlet throat defining a tapering neck;

mounting means of said first type including three studs secured to said collar which project out from said thrust axis at about 70°; and said collar and said neck being connected together by connection straps leaving openings between said collar and neck; said collar, neck and straps being formed of relatively thin injected plastic.

12. An air ejection nozzle adapted for use with a toy balloon having a highly extensible elastic wall and a base provided with an inflation appendix;

said nozzle having a thrust axis and comprising a wide inlet edge and a narrow outlet throat;

said inlet edge being adapted to bear against a balloon base;

said outlet throat being adapted to receive a folded portion of an inflation appendix of a toy balloon;

said nozzle functioning to prevent air from escaping from a balloon when said balloon is installed with said nozzle, inflated and then rotated relative to the nozzle;

said nozzle further comprising:

mounting means of a first type uniformly distributed around said thrust axis;

said mounting means of a first type being adapted to securely hold relatively rigid, lightweight, long thin cylindrical members in directions that slope relative to said thrust axis;

at least one mounting means of a second type disposed between said inlet edge and said outlet throat;

said mounting means of a second type being adapted to securely hold aside said thrust axis a relative rigid, lightweight, long and thin cylindrical member in a direction substantially parallel to said thrust axis.

13. An air ejection nozzle according to claim 12 wherein:

said inlet edge is a circular collar and said outlet throat is a tapering neck;

said mounting means of said first type are three studs secured to said collar which project out from said thrust axis at about 70°;

mounting means of said second type are three cylindrical tubes, each having one of its ends secured to said collar and the other of its ends open and directed towards said neck; and said collar and said neck are connected together by three connection straps leaving openings between said collar and neck, each of said straps being integral with a stud and a one cylindrical tube, said collar, neck and straps being formed of relatively thin injected plastic.

14. A jet flying toy comprising:

a toy balloon having a highly extensible elastic wall and a base provided with an inflation appendix;

an air ejection nozzle having a thrust axis and comprising a wide inlet edge and a narrow outlet throat;

said inlet edge being adapted to bear against a balloon base;

said outlet throat being adapted to receive a folded portion of an inflation appendix of a toy balloon;

said nozzle including at least three mounting means uniformly disposed around said thrust axis;

each of said mounting means being adapted to securely hold a relatively rigid, lightweight, long and thin cylindrical member; and a trajectory stabilizer constituted by three relatively rigid, lightweight, long and thin members respectively mounted on said three mounting means, each of said long and thin members being provided with a fin.

15. A jet flying toy adapted to fly and to glide comprising:

a toy balloon having a highly extensible elastic wall and a base provided with an inflation appendix;

an air ejection nozzle having a thrust axis, a wide inlet edge and a narrow outlet throat;

said nozzle including three first type mounting means uniformly disposed around said inlet edge, said first type mounting means being adapted to hold relatively rigid and lightweight long members in directions that slope relative to said thrust axis at about 70°;

said nozzle also including at least one second type mounting means disposed between said inlet edge and said outlet throat, in a position central relative to two of said first mounting means, said second type mounting means being adapted to hold relatively rigid and lightweight long members in a direction substantially parallel to said thrust axis;

said nozzle being adapted to be mounted on said appendix with its inlet edge bearing against said balloon base and with a part of the appendix being folded back over said outlet throat;

said nozzle becoming a closure means when inflated and then rotated relative to the nozzle;

a fuselage defined by one of said long members provided with a fin, said fuselage removably and fixed on one of said second type mounting means;

two wings, each comprising a spar and a skin, said spar being one of said long members and said skin being an elongated sheet of paper secured on said spar;

said wings being fixed by means of their spars to two of said first type mounting means which are symmetrically disposed about said nozzle.

* * * * *